United States Patent [19]

Milliser et al.

[11] Patent Number: 4,880,323

[45] Date of Patent: Nov. 14, 1989

[54] HIGH-SYMBOL DENSITY PRINTER CARTRIDGE HAVING A FLEXIBLE EXIT ARM, GEAR SHIELD AND SUPPORT SPACERS

[75] Inventors: Charles E. Milliser; John M. Karalevicz; Harry C. Quick, all of Waynesboro, Va.

[73] Assignee: Genicom Corporation, Waynesboro, Va.

[21] Appl. No.: 183,083

[22] Filed: Apr. 19, 1988

Related U.S. Application Data

[63] Continuation-in-part of Ser. No. 81,245, Aug. 4, 1987, abandoned.

[51] Int. Cl.[4] ..... B41J 32/02

[52] U.S. Cl. ..... 400/196.1; 400/208; 400/224; 400/234; 400/248

[58] Field of Search ..... 400/194, 195, 196, 196.1, 400/207, 208, 208.1, 224, 234, 248

[56] References Cited

U.S. PATENT DOCUMENTS

| | | | |
|---|---|---|---|
| 2,734,615 | 2/1956 | Van Wallendael | 400/224 |
| 3,720,954 | 3/1973 | Czyryk | 400/208 X |
| 4,084,683 | 4/1978 | Moss | 400/248 X |
| 4,114,751 | 9/1978 | Nordin | 400/248 |
| 4,134,693 | 1/1979 | Crickmore et al. | 400/208 |
| 4,188,134 | 2/1980 | Garrido | 400/208 |
| 4,209,261 | 6/1980 | Bell et al. | 400/196.1 |
| 4,231,667 | 11/1980 | Behrendt et al. | 400/208 |
| 4,257,282 | 3/1981 | Wilczewski et al. | 400/224 X |
| 4,307,969 | 12/1981 | Daughters | 400/208 |
| 4,350,451 | 9/1982 | Furrow | 400/224 X |
| 4,397,575 | 8/1983 | Aldrich | 400/208 |
| 4,405,247 | 9/1983 | Hanna | 400/195 X |
| 4,446,790 | 5/1984 | Konkel et al. | 400/208 X |
| 4,589,789 | 5/1986 | Quick et al. | 400/224 X |
| 4,623,274 | 11/1986 | Ohsaki | 400/208 |
| 4,630,948 | 12/1986 | Karns | 400/195 X |
| 4,663,637 | 5/1987 | Saitou | 400/208 X |
| 4,728,207 | 3/1988 | Foster | 400/208 X |
| 4,770,553 | 9/1988 | Deschamps et al. | 400/208 |

FOREIGN PATENT DOCUMENTS

| | | | |
|---|---|---|---|
| 0075084 | 3/1983 | European Pat. Off. | 400/208 |
| 2019648 | 11/1971 | Fed. Rep. of Germany | 400/248 |
| 0077180 | 6/1981 | Japan | 400/196.1 |
| 0055280 | 4/1983 | Japan | 400/196.1 |
| 0059488 | 4/1984 | Japan | 400/208 |
| 0194883 | 11/1984 | Japan | 400/208 |
| 0079988 | 5/1985 | Japan | 400/224 |
| 0016878 | 1/1986 | Japan | 400/208 |
| 0019479 | 1/1987 | Japan | 400/224 |
| 661477 | 7/1987 | Switzerland | 400/248 |

OTHER PUBLICATIONS

IBM Technical Disclosure Bulletin, "Tracking Roll", Baumberger et al., vol. 21, No. 8, Jan., 1979, p. 3126.

IBM Technical Disclosure Bulletin, "Roller Arrangement For Obtaining Slack Ribbon in a Printer", vol. 29, No. 10, Mar., 1987 pp. 4688–4689.

Xerox Disclosure Journal, "Uniform Ribbon Tension For Impact Printer Ribbon," Leicht, vol. 4, No. 2 Mar.-/Apr., 1979, pp. 181–182.

*Primary Examiner*—Ernest T. Wright, Jr.

*Attorney, Agent, or Firm*—Nixon & Vanderhye

[57] ABSTRACT

A shuttle matrix printer cartridge has a housing for storing the ribbon, an exit arm, an entrance arm spaced from the exit arm and a drive mechanism for removing ribbon from the storage chamber through the exit arm into position for printing between a printhead and a substrate and reentry into the cartridge through the entrance arm. The entrance arm is flexible in the plane of the cartridge toward and away from the exit arm to facilitate changes in ribbon drag produced during high dot density printing. The cartridge has three spacer legs along its underside for supporting the cartridge on the printer platform in use. Additionally, a post engages a recess in the exit arm to maintain the latter arm rigid during use, while such post, in conjunction with a drive shaft carried by the printer and received in a cartridge drive wheel, positions the cartridge in the printer against lateral movement. A shield is disposed between the drive gears and nip rollers in the drive mechanism to prevent ensnarlment of the ribbon in the drive gears.

28 Claims, 5 Drawing Sheets

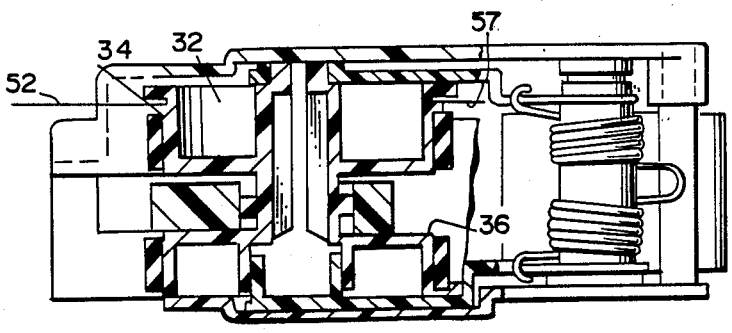
FIG. 9
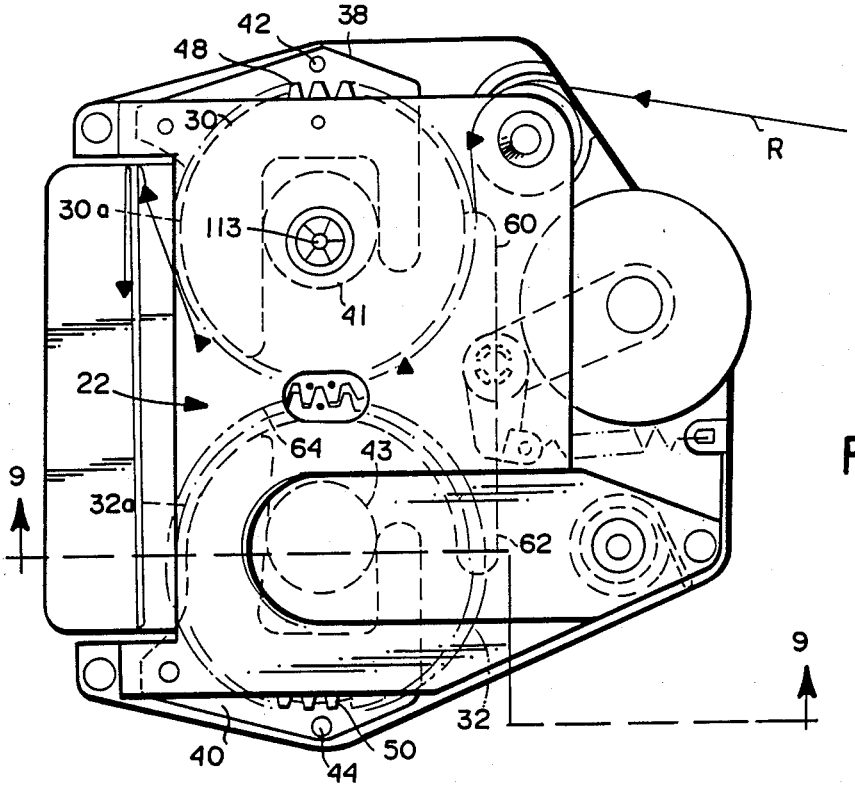
FIG. 8
FIG. 10
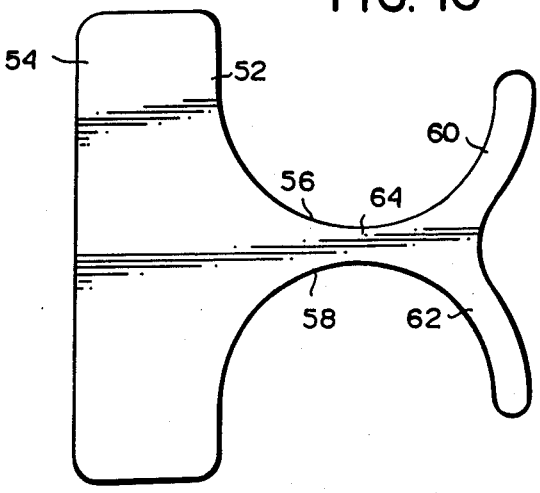
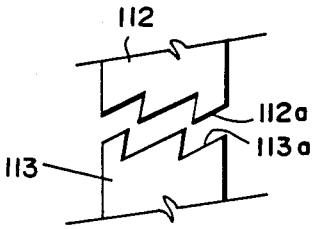
FIG. 8A

HIGH-SYMBOL DENSITY PRINTER CARTRIDGE HAVING A FLEXIBLE EXIT ARM, GEAR SHIELD AND SUPPORT SPACERS

RELATED APPLICATIONS

This application is a continuation-in-part of application Ser. No. 081,245, filed August 4, 1987, abandoned for OSCILLATING RIBBON STRIPPERS FOR ENDLESS LOOP INK RIBBON CARTRIDGE.

BACKGROUND OF THE INVENTION

The invention relates to inked ribbon cartridges, and particularly to cartridges for use on printers, such as shuttle matrix printers. Such cartridges are used for storing printing ribbon, such as inked fabric, carbon film, etc. within a storage chamber and from which chamber it may be withdrawn for printing. The invention also relates to a ribbon cartridge constructed to enable control of the position of the ribbon with respect to the print line to accommodate changes in ribbon drag produced during high dot density printing, to facilitate positioning of the cartridge in printing position, and to facilitate ribbon feed into the storage chamber without interference between the ribbon storage mechanism and the ribbon.

In high-speed shuttle matrix printer cartridges, for example of the type disclosed in parent application Ser. No. 081,245, ribbon is passed into the nip between a drive roller and driven roller enroute to a storage chamber. Strippers are used to play the ribbon emerging from the nip back and forth between opposite sides of the cartridge storage chamber to provide substantially uniform folds of ribbon throughout the extent of the storage chamber. The drive roller and driven roller also cause the ribbon to be removed from the storage chamber along an exit arm for disposition in a print position for coaction with a printhead having print wires or styli to produce a series of printing dots on the substrate. The ribbon is continuously moved by the drive and driven rollers through the print position and by way of an entrance arm back to the storage chamber.

One of the principal problems associated with printers of this type, particularly printers employing a high-speed shuttle matrix printer cartridge, is the capacity to accommodate the changes in ribbon drag caused by the interaction of the print wires and ribbon during high dot density printing when the print wires tend to brake or restrain ribbon movement. When the print wires or styli on the moving printhead impact the ribbon, they instantaneously brake the ribbon movement. As the print density, i.e., dots per inch, increases, this braking action may reach excessive proportions. With a relatively rigid entrance arm, and with the printhead moving in a direction opposite to the direction of movement of the ribbon, the braking or restraining action of the printhead on the ribbon causes the rotating drive wheels to increase the tension on the ribbon. This can cause the ribbon to skew out of alignment and, in an extreme case, cause the ribbon in contact with the print wires to be scraped, punctured or torn. Additionally, the stoppage of the ribbon caused by the interaction of the printhead with the ribbon results in the ribbon slipping on the drive wheel. This adversely affects the tracking of the ribbon into the cartridge, resulting in ribbon creasing, foldover, and twisting or causes the ribbon to be displaced in its own plane up or down the ribbon entrance arm. Twisting of the ribbon also causes the ribbon to track up or down relative to the line of print wires. This results in undesirable folding or wrinkling at the port of the entrance arm, and movement of the ribbon out of the wire printing range. This can lead to a derogation of print performance and ultimately to a failure of the printer to print at all.

When the ribbon is snagged or momentarily braked, and the printhead is moving in the direction of the ribbon flow, the printhead assists in advancing the ribbon more rapidly than the advance thereof caused by the drive wheels. This causes an excessive amount of ribbon to be pulled out of the ribbon cartridge and a slack in the ribbon between the printhead and the entrance nip of the drive rollers. This action causes similar results as stated above and may jam the ribbon in the cartridge.

It will be appreciated that the printhead moves rapidly back and forth along the print line. The adverse results caused by the interaction of the print wires and the ribbon and the back-and-forth movement of the printhead relative to the unidirectional movement of the ribbon quickly multiply. This results in improper ribbon flow, adversely affecting print quality, and causes damage to the ribbon and the print wires.

Accurate positioning and orientation of the cartridge in the printer is likewise essential for repeated quality printing. In solving the above-identified problems associated with the interaction of the printhead and the ribbon, it is essential that the cartridge at the same time be readily and easily mounted in the printer in proper position and orientation to address the banks of print wires to achieve effective quality printing.

Additionally, in those cartridges which employ a drive mechanism for folding ribbon into the storage chamber, there is the tendency, particularly as a result of the above-noted interaction between the printhead and ribbon, for the ribbon to track in the cartridge storage mechanism differently than in its designed track. Often, this locates the ribbon in the drive mechanism per se. Thus, the ribbon may become entangled in its own drive mechanism, causing a complete breakdown of the ribbon flow from the storage chamber into print position and return. It is therefore essential that the ribbon be maintained free and clear of the drive mechanism per se.

SUMMARY OF THE INVENTION

Now we have discovered an improved ribbon cartridge for high density printing. We have discovered that a high-speed ribbon cartridge may be constructed to accommodate changes in ribbon drag produced during high dot density printing.

We have also discovered a design which facilitates positioning and orientation of the cartridge in the printer and substantially precludes a jamming of the ribbon in the cartridge caused by interference between the ribbon and the drive mechanism for folding the ribbon in the cartridge storage chamber.

In one exemplary embodiment, a ribbon cartridge has a drive mechanism and a ribbon storage chamber with a ribbon exit arm and a ribbon entrance arm at opposite ends of the cartridge such that ribbon extends between the distal ends of the arms across the span of the printing substrate in one area for coaction with a printhead to print on the substrate. This ribbon exit arm may be formed and located in the printer so as to constitute a rigid arm. For example, it may be provided with solid continuous side, top and bottom walls which lend rigidity to the arm. To further facilitate the rigidity of the exit arm, a post on the printer may be received in a mounting recess formed on the underside of the arm such that the exit port of the exit arm is fixed rigidly in position.

Conversely, an exemplary ribbon entrance arm embodiment is constructed and dimensioned to enable an angular flexing movement of the end of the arm in the plane and along the direction of the ribbon travel and without substantial rotational or twisting movement of the arm about its linear axis. In one exemplary embodiment, the ribbon entrance arm is provided with cutouts or voids in its upper and lower surfaces dimensioned and configured to permit flexing movement substantially only in the plane of the cartridge. Other embodiments may include relative dimensioning of the walls of the arm both in thickness and in breadth to depth, etc.

Thus, when the cartridge is mounted in a printer, the entrance arm is relatively free for flexing movement, e.g., such that its entrance port is movable generally toward and away from the opposite exit arm in the plane of the cartridge. By rendering the entrance arm flexible in this plane and by also providing a relatively rigid exit arm for the ribbon, tracking of the ribbon in the cartridge is more accurately and repeatedly maintained substantially without creasing, foldover or twisting or causing the ribbon to track up and down the arms, thereby avoiding the previously stated deleterious effects.

To facilitate mounting of the cartridge in the printer, the cartridge may be provided with three spacer legs. One of the legs may constitute a projection along the underside of the ribbon exit arm and in which projection the recess for the mounting post is formed. A second projection along the underside of the cartridge is provided on the flexible entrance arm. A third mounting projection is located on the opposite side of the cartridge, specifically proximate the center of mass of the cartridge and as far as possible from the first and second spacer projections. While it might be preferable to mount this third projection along a transverse line passing through the center of mass of the cartridge and normal to a line interconnecting the first and second projections, to further balance the cartridge, the third projection may be located at the furthest distance from the first and second projections and spaced from the normal line passing through the center of mass.

To properly position and orient the cartridge in the printer and to provide an interconnection between a printer drive mechanism and the cartridge drive rollers, the cartridge may have, along its underside, a female receptacle for receiving the splined drive shaft on the printer. Consequently, positioning of the cartridge in a horizontal plane containing the cartridge and the direction of ribbon drive, may be achieved solely by the printer mounting post and spline connection with the cartridge, i.e., a two-point location is provided. The underside of the cartridge also may have a protruding annular rim which mates with a recessed ring on the platform of the printer receiving the cartridge. The rim does not, however, bottom on the platform. The protruding rim and recessed ring of the cartridge and printer platform, respectively, facilitate centering the driveshaft carried by the printer in the female splined cartridge recess and also minimize oscillation of the cartridge during printing without the rim bottoming on the recessed ring.

A shield may also be interposed between the drive gears for the ribbon drive wheels and the drive wheels per se. The shield prevents the ribbon from ensnarlment in the drive gears.

A high-speed shuttle matrix printer cartridge carrying a print ribbon for disposition in a print position between a printhead and a print recording medium, may include a housing defining a storage chamber for the ribbon, a means (e.g., including exit and entrance arms spaced one from the other and projecting from the housing) for routing the ribbon from the storage chamber along the exit arm into the print position and from the print position along the entrance arm to the storage chamber. Means may also be provided for moving the ribbon into the storage chamber, thereby displacing the ribbon from the exit arm through the print position and along the entrance arm, one of the arms being movable in a plane generally containing the arms in response to changes in ribbon tension produced during printing. Preferably, the movable arm constitutes the entrance arm which has side, upper and lower walls for confining the ribbon therebetween, each of the upper and lower walls having openings therethrough enabling the entrance arm to flex in the plane of the cartridge without twisting.

In another preferred embodiment, a ribbon cartridge for attachment to a printer may include a housing defining a ribbon drive and ribbon storage chamber, a pair of spaced-apart arms extending from the cartridge for delivering a substantial span of ribbon from the cartridge via one arm to a print line established between the arms back to the cartridge via the other arm. One of the arms has a ribbon outlet from the cartridge and the other arm has a ribbon inlet to the cartridge. Means are provided for ensuring proper ribbon movement from the outlet arm to the inlet arm and relative to the established print line (e.g., the outlet arm is substantially rigid during ribbon movement when attached to the printer and the inlet arm is configured to be substantially flexible during ribbon movement when attached to the printer). Preferably, the inlet arm is dimensioned to flex substantially in the direction of ribbon movement and means are provided for restraining rotation of the inlet arm relative to the direction of ribbon movement during flexing.

The ribbon cartridge also may include a housing defining a ribbon drive chamber and a ribbon storage chamber coupled to the drive chamber and having a smaller width than the drive chamber. In this case, a ribbon drive means may be mounted in the chamber and an inlet arm and an outlet arm extended from the cartridge for delivering a span of ribbon along the print line from the storage chamber and back into the drive chamber in response to an external force applied to the drive means. Means may be provided for maintaining proper ribbon movement in the span between the arms during printhead movement along the print line, including means for maintaining the outlet arm rigid with respect to the print line and the means for maintaining the inlet arm flexible along the direction of the print line without rotation relative to the direction of ribbon movement during flexing of the inlet arm.

BRIEF DESCRIPTION OF THE DRAWING FIGURES

The accompanying drawings, which are incorporated in and constitute a part of this specification, illustrate one exemplary embodiment of the invention in which:

FIG. 8 is an enlarged top plan view of the inked ribbon cartridge drive assembly forming part of the cartridge illustrated in FIG. 1;

FIG. 8A is a schematic illustration of a one-way clutch cooperable between the drive shaft and drive knob in the ribbon drive mechanism;

FIG. 9 is a cross-sectional view thereof taken generally about on line 9—9 in FIG. 8; and FIG. 10 is a plan view of a floating ribbon shield disposed between the synchronizing drive gears and the ribbon drive and driven wheels.

DETAILED DESCRIPTION OF THE DRAWING FIGURES

Reference will now be made in detail to the presently preferred embodiment of the invention, an example of which is illustrated in the accompanying drawings.

The contents of U.S. patent application Ser. No. 081,245, filed August 4, 1987 for "Oscillating Ribbon Strippers for Endless Loop Ink Ribbon Cartridge" are incorporated herein by reference to application Ser. No. 081,245 as though fully set forth herein.

Figure 6:
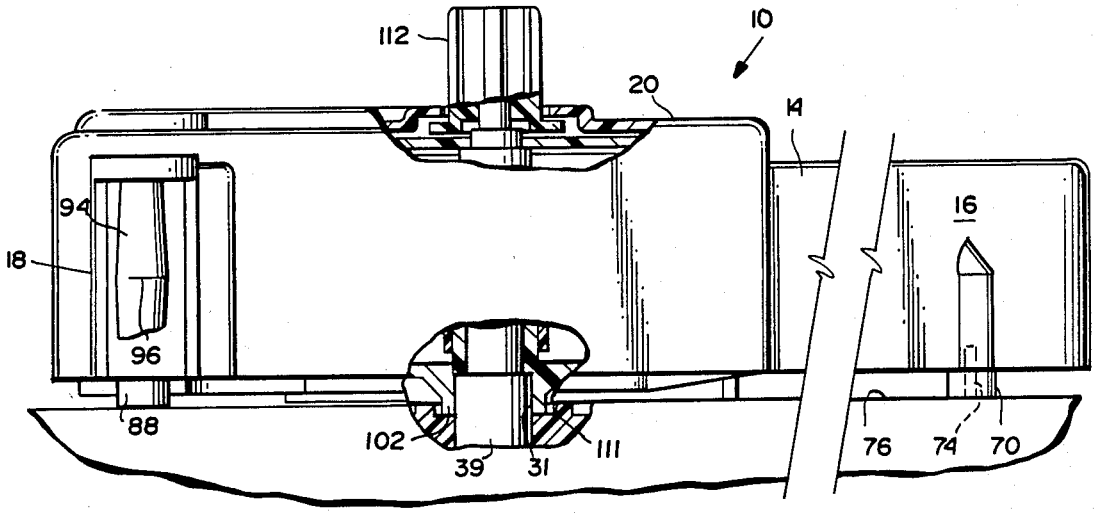
FIG. 6 is an enlarged view similar to FIG. 5 with parts broken out and in cross-section.

Generally, an inked ribbon cartridge assembly 10 is intended for use in a shuttle matrix impact printer (not shown except to the extent the printer mounting platform is illustrated in FIG. 6). It includes a housing 12 (preferably formed of plastic material) having an elongated storage chamber 14, a laterally enlarged processing chamber 11, and exit (outlet) and entrance (inlet) arms 16 and 18, respectively, at opposite ends of assembly 10. Housing 12 also includes a body section 20 for receiving the inked ribbon cartridge drive assembly, generally designated 22 (FIGS. 8 and 9).

Figure 1:
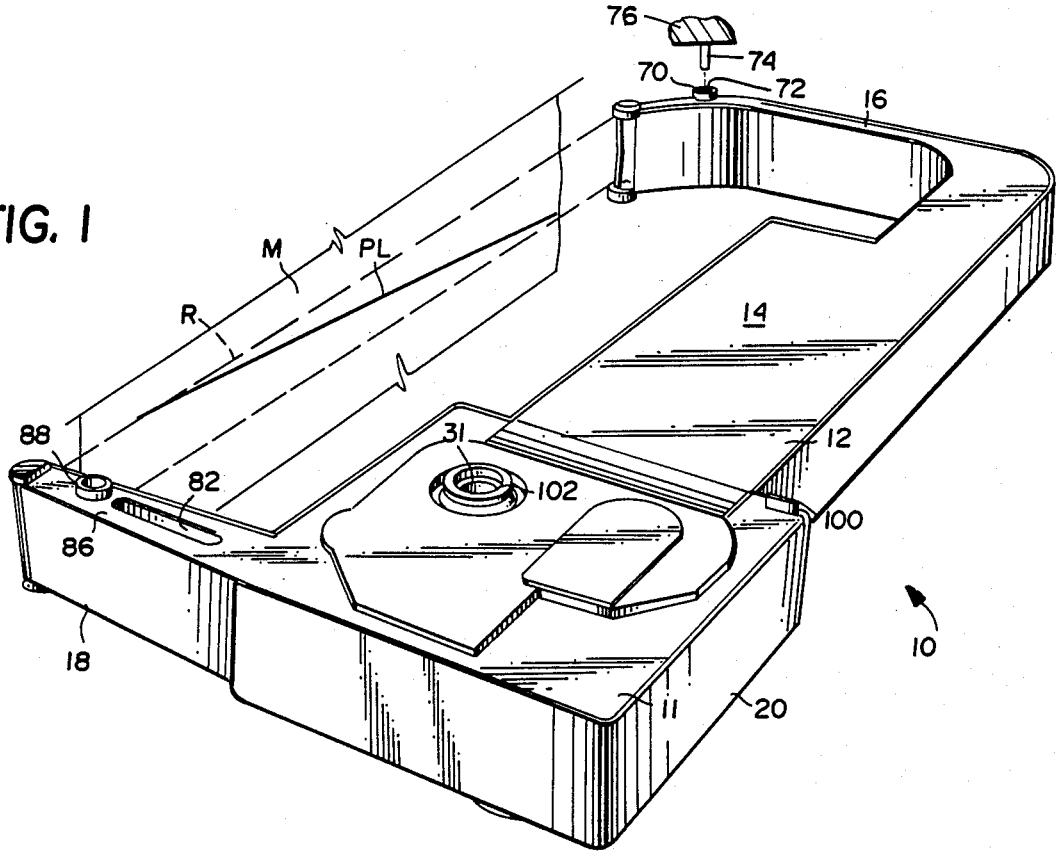
FIGS. 1 and 2 are respective bottom and top perspective views of an exemplary ribbon cartridge embodiment constructed in accordance with the present invention.
Figure 2:
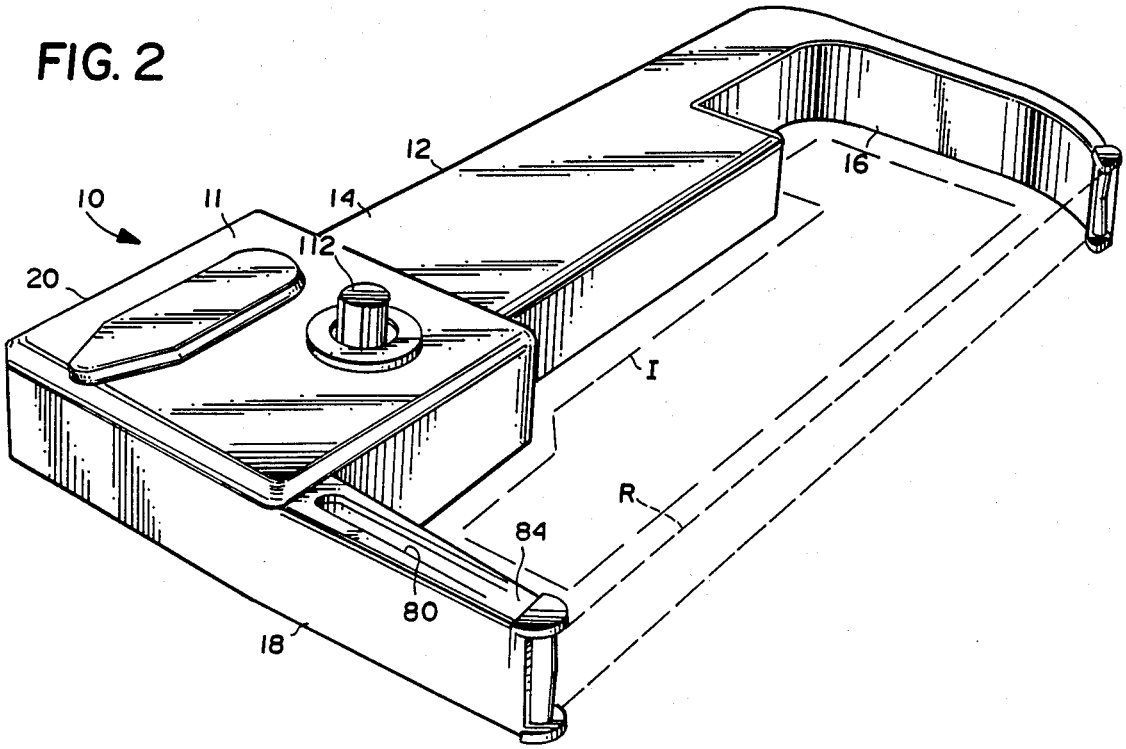
Figure 7:
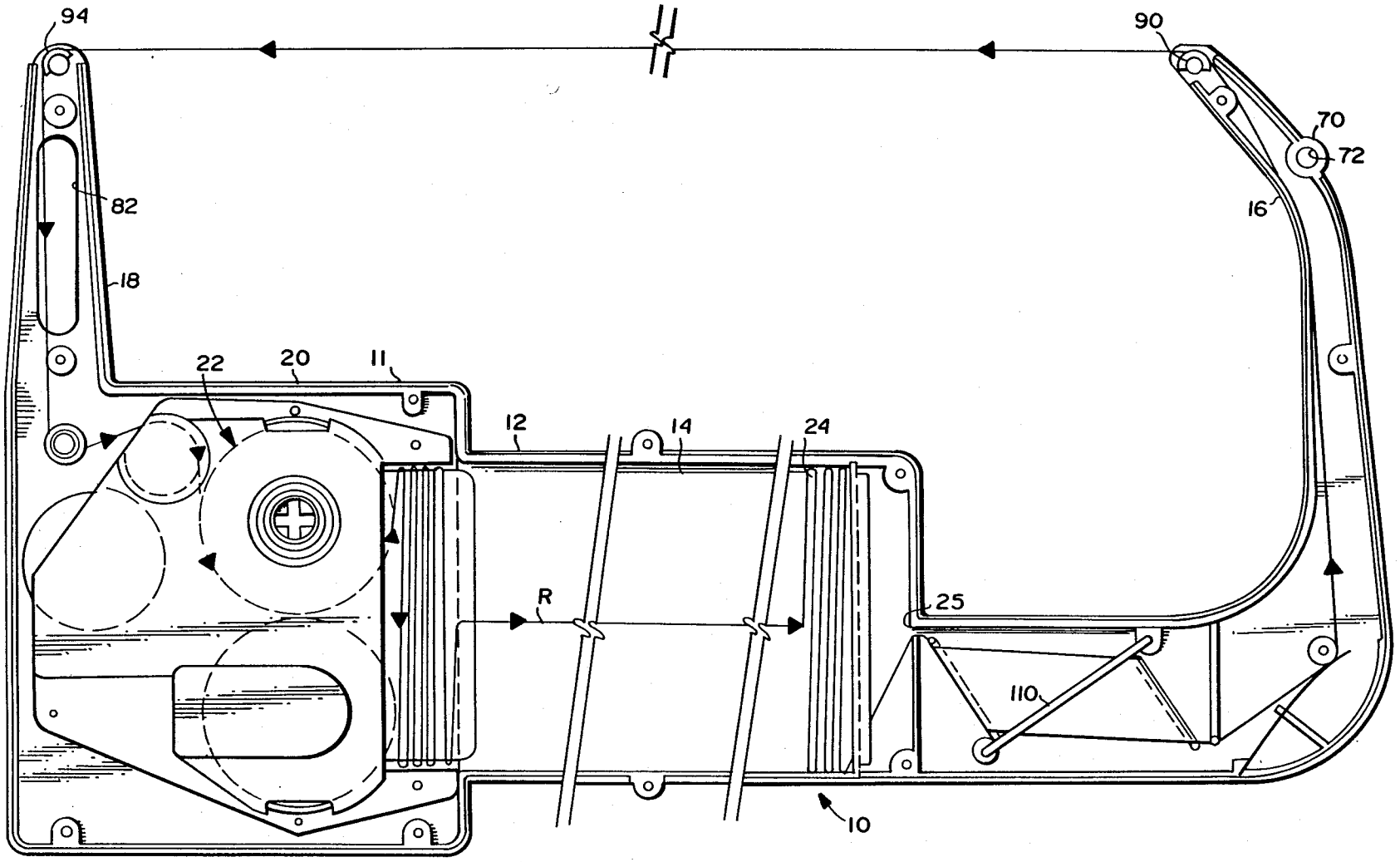
FIG. 7 is an enlarged bottom plan view of the cartridge of FIG. 1 with the bottom housing plate removed, illustrating the drive mechanism and storage chamber for the ribbon.

Generally, a continuous inked ribbon R is stored in chamber 14 in multiple, approximately transversely extending uniform folds 24 (FIG. 7) extending back and forth across chamber 14. Ribbon R is taken from chamber 14 through an exit slot 25 (FIG. 7) and inverted 180° by a mobius loop inverter 110 (for example, as described in U.S. Pat. No. 4,630,948). It is then passed about various posts and through exit arm 16 for registry with an impact printing mechanism I (e.g., a shuttle dot matrix printhead, protective cover, air ducts, etc. shown in dotted form in FIG. 2), located between arms 16 and 18 and the ribbon R to print on a record medium or substrate M. After use, it is passed into entry arm 18 for return to storage chamber 14 under the action of drive assembly 22.

Printing may take place along a print line PL on the medium M along a line parallel or skewed with respect to ribbon direction of movement. This may be achieved, for example, by positioning the cartridge assembly 10 on the platform 76 to be at an oblique angle with respect to the print line PL.

As disclosed in the related prior patent application, Ser. No. 081,245, drive assembly 22 includes drive roller 30 (FIG. 8) and driven roller 32. In brief, each of rollers 30 and 32 comprises tiered pinch rollers disposed about a common axis, for example, the pinch rollers 34 and 36 illustrated in FIG. 9 for driven roller 32. Drive roller 30 (FIG. 6) is suitably driven by a splined post 39 upstanding from the printer platform 76 and which part is received, upon mounting the cartridge assembly 10 on the platform 76 in a correspondingly splined recess 31 along the underside of cartridge assembly 10. Ribbon R (FIG. 8) is therefore received within drive housing or processing chamber and routed through the nip between the pairs of pinch rollers 34 and 36 for introduction into the storage chamber 14. The drive and driven rollers 30 and 32, respectively, have strippers 38 and 40, respectively, mounted for oscillation about pivot points 42 and 44. Strippers 38 and 40 are generally C-shaped and are mounted for oscillatory movement by rotation of cams 41 and 43, respectively. Thus, upon rotation of rollers 30 and 32, forwardly directed surfaces **30*a* and 32*a* on the strippers 38 and 40 oscillate between positions within and without the confines of the pinch rollers 34 and 36 to play the ribbon R back and forth between the edges of the storage chamber 14 as the ribbon R is advanced. The drive roller 30 drives roller 32 by drive gears 48 and 50, which lie in mesh (one with the other) above the nip formed by the paired pinch rollers 34 and 36**.

In accordance with one aspect of the present invention, a floating shield 52 (FIG. 10) is disposed between the drive gears 48 and 50 and the uppermost rollers of the pairs of pinch rollers 34 and 36. As illustrated in FIG. 10, shield 52 is formed of flat sheet material, preferably stainless steel, having a generally rectangular base portion 54, two semi-cylindrical cutouts 56 and 58 on opposite sides thereof defining a neck 64 therebetween and a pair of arcuately outwardly directed legs 60 and 62 at the end thereof opposite base portion 54. Shield 52 is disposed between drive gears 48 and 50 and the uppermost rollers of the pairs of pinch rollers such that neck 64 thereof is disposed between the meshed gears 48 and 50 and the nip formed by the tiered pinch rollers 34 and 36. The uppermost pinch roller of each pair thereof has a radial groove 57 (FIG. 9) for loosely receiving the margins of the circular cutouts 56 and 58 of shield 52.

Referring now to FIGS. 1–4, the cartridge assembly 10 is specifically constructed to accommodate changes in ribbon drag produced during high dot density printing. To accomplish this, a substantially rigid ribbon exit arm 16 and, in comparison, a flexible ribbon entrance arm 18 is provided. Thus, exit arm 16 has side, top and bottom walls which are solid and continuous to afford rigidity to the arm 16 as it projects from the cartridge assembly 10. To additionally further rigidify exit arm 16 in use, its underside has a downwardly projecting boss or leg 70, which forms part of the three-point cartridge mounting system described hereinafter. Boss 70 has a recess 72 which, as illustrated in FIG. 6, cooperates with a pin 74 carried on the carriage platform 76. When the cartridge assembly 10 is mounted in the printer, pin 74 is located within recess 72 and positions the cartridge assembly 10 relative to the printer. Thus, when the cartridge assembly 10 is mounted in printing position, the structural rigidity of the exit arm 16 is augmented by its securement against movement in the plane of the cartridge by the mounting pin 74 and recess 72 arrangement.

Figure 3:
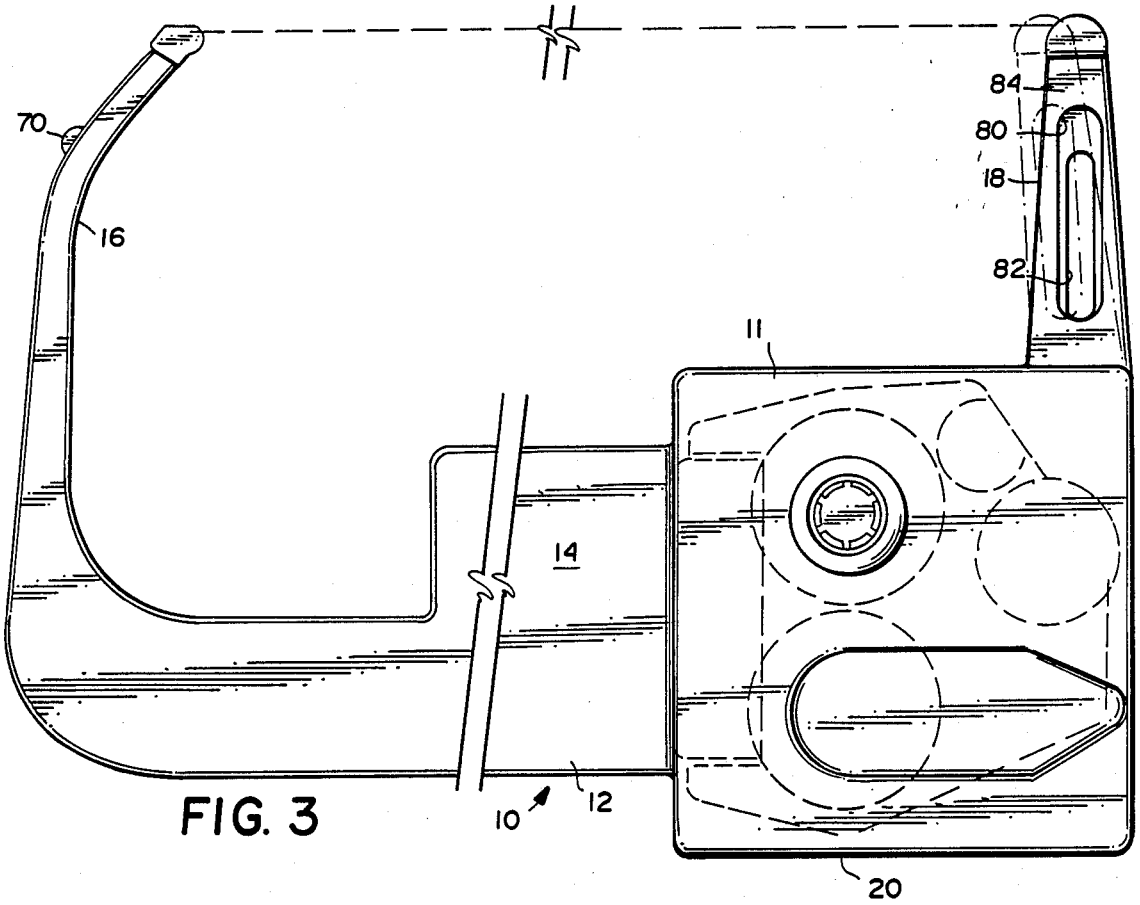
FIGS. 3 and 4 are respective top and bottom plan views with parts broken out of the ribbon cartridge illustrated in FIG. 1.
Figure 4:
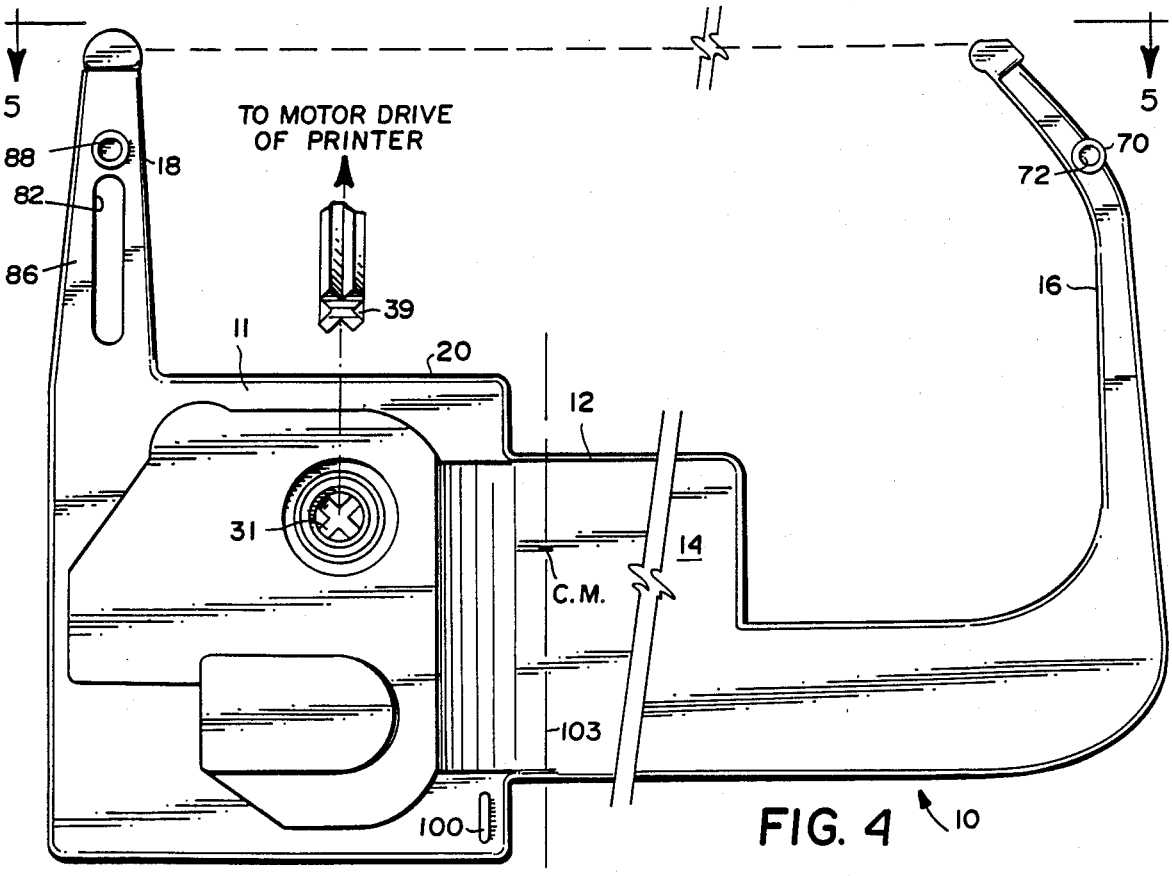

Contrary to this construction, the entrance arm 18 is specifically configured for flexing movement in the plane of the cartridge assembly 10 as particularly illustrated with reference to FIG. 3 by a comparison of the full and dashed line configurations of arm 18. The illustration of the flexing motion of arm 18 in FIG. 3 is exaggerated. However, arm 18 is specifically constructed to facilitate a flexing movement in the plane of the cartridge assembly 10 by providing openings 80 and 82 in the top and bottom walls 84 and 86 thereof, respectively. A mounting leg or projection 88 is formed along the underside of entry arm 18, as illustrated in FIG. 4. However, leg 88 simply rests on, rather than being fixed to, platform 76 when the cartridge assembly 10 is mounted in the printer and is thus adapted for sliding movement relative to the printer. Consequently, angular flexing movement of entrance arm 18 in the plane of ribbon travel and without substantial rotational or twisting movement thereof about its linear axis or out of such plane is provided. By providing an entrance arm 18 flexible in the plane of the cartridge assembly 10 and a rigid exit arm 16, tracking of the ribbon R in the cartridge assembly 10 is accurately and repeatedly maintained without ribbon R foldover or twisting or causing the ribbon R to track up and down the arms 16 and 18.

To further facilitate maintaining the ribbon R in proper position relative to the printhead, i.e., the line of print PL, the guide surfaces at the ends of the entrance and exit arms 18 and 16, respectively, are specifically shaped to assist in maintaining the ribbon R in the plane of the cartridge assembly 10. Particularly, the guide surface 90 at the tip of the exit arm 16 tapers from its opposite ends inwardly to a reduced diameter central or middle portion 92. The guide surface 94 at the tip of the entrance arm 18 tapers from a larger diameter mid-portion 96 in opposite directions towards its smaller diameter opposite ends.

To facilitate mounting of the cartridge assembly 10 in the printer, a three-point mounting system is provided for supporting the cartridge assembly 10 on the printer platform 76. To accomplish this, first, second and third spacer legs 70, 88 and 100 are provided along the underside of the cartridge assembly 10. Spacer legs 70, 88 and 100 project downwardly from the underside of cartridge assembly 10 and support the cartridge assembly 10 on printer platform 76. It will be appreciated that two of the spacer legs, i.e., 70 and 88, lie adjacent the extremities of the exit and entrance arms 16 and 18, respectively, projecting from the bottom of the cartridge assembly 10. The third mounting leg 100 projects from the bottom of the cartridge assembly 10 and approximate the center of mass C.M. and spaced from mounting legs 70 and 88. Because of the dimensioning of chamber 11, leg 100 is selected to lie to one side of an imaginary line 103 through the center of mass C.M. and normal to an imaginary line interconnecting legs 70 and 88 for purposes of locating leg 100 as far from legs 70 and 88 as possible and hence afford substantial stability to the cartridge assembly 10 when mounted in the printer.

Figure 5:
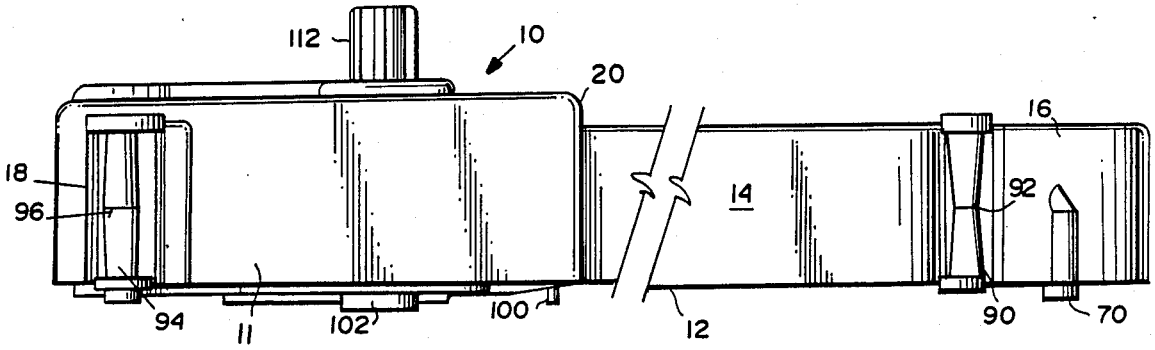
FIG. 5 is a side elevational view of the cartridge taken generally about on line 5—5 in FIG. 4.

As illustrated in FIGS. 5 and 6, the chamber 11 has an annular rim 102 coincident with the center line of the drive wheel 30 and projects downwardly from the underside of cartridge assembly 10. The rim 102 is disposed about the splined drive shaft 39 of the printer and mates with a recessed ring 111 in the printer platform 76 surrounding the drive shaft. The rim 102 mates with the recessed platform ring 111 concentrically to assist in centering the cartridge assembly 10 when the cartridge assembly 10 is installed on the platform 76.

To install the cartridge assembly 10 in the printer, the cartridge assembly 10 is oriented relative to the printer platform 76 such that the drive post 39 is received in the drive roller splined recess 31 and the post 74 is received in the recess 72 of mounting leg 70. The cartridge assembly 10 is then lowered onto the platform 76 such that legs 70, 88 and 100 engage platform 76. Thus, the cartridge assembly 10 is mounted against rotation in the plane of the cartridge assembly 10 by engagement of post 74 in recess 72 and drive shaft 39 in recess 31 of the drive wheel 30, with the entire support for the cartridge assembly 10 derived from the three spacer legs 70, 88 and 100 engaging platform 76. In this latter mounted condition, the rim 102 does not bottom on the platform ring 111 but rather only concentrically engages the recessed ring 111 carried by the platform 76.

Upon installation, it may be necessary to advance the ribbon drive mechanism in a direction to draw the ribbon R taut. This facilitates feeding the ribbon between the printheads and the print medium M, and minimizes the likelihood of ribbon jam due to tracking misalignment because of excess ribbon R. to overcome this likelihood, it is common to provide a knob, such as 112 shown in FIG. 2. This knob 112 engages drive wheel shaft 113 (FIG. 8). By rotating the knob 112 in the proper direction, the ribbon R in the span is drawn taut by being fed into the storage chamber 14 in certain instances, as where a wide ribbon R is involved (such as 1⅜" in the case of one shuttle printer) and the ribbon R in the storage chamber 14 is uniformly fan-folded (broad folds) rather than random folded (small, irregular folds), it is vital that the knob 12 not be turned in the wrong direction, such as to undesirably draw ribbon R from the storage chamber 14 to the inlet arm 18. In so doing, the combination of the wide ribbon R and the back pressure of the wide folds results in ribbon R clumping at the nip (in the reverse ribbon drive direction). Also, drawing ribbon R back toward the span by the drive rollers 30 and 32 from the storage chamber 14 results in undesirable ribbon foldover and buckling at the nip between the rollers 30 and 32 and beyond, introducing excessive torque loading on or jamming the drive rollers 30 and 32 for printing. To avoid these undesirable shortcomings, knob 112 is coupled to drive wheel shaft 113 by a one-way clutch, as shown schematically in FIG. 8A, by the serrated teeth **112*a* and 113*a* on the knob 112 and the shaft 113, respectively. This ensures that under no circumstances will the operator be able to draw ribbon R back to the span from the storage chamber 14**.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A printer cartridge for carrying a print ribbon for disposition in a print position between a printhead and a print recording medium, comprising:

a housing defining a storage chamber for the ribbon;

means including ribbon exit and entrance arms spaced one from the other and projecting from said housing for routing the ribbon from the storage chamber along said exit arm into the print position located in the span between said arms and from the print position along said entrance arm to the storage chamber;

means for moving the ribbon into said storage chamber thereby displacing the ribbon from the exit arm through the print position and along the entrance arm;

one of said arms comprising a ribbon guide proximate its end remote from said cartridge for guiding ribbon from said span to said entrance arm, means for minimizing adverse loading on said ribbon during high density printing comprising dimensioning said one arm to flex along the direction of ribbon movement in said span during such high density printing while maintaining said guide perpendicular to said ribbon movement.

2. A cartridge according to claim 1 wherein said one arm constitutes said entrance arm, said entrance arm being movable toward and away from said exit arm during printing.

3. A cartridge according to claim 1 wherein said one arm is flexible and the movement of said one arm is provided by a flexing thereof.

4. A cartridge according to claim 1 wherein said one arm is flexible and constitutes said entrance arm with the movement of said entrance arm being provided by a flexing thereof.

5. A cartridge according to claim 4 wherein said entrance arm has a side wall and upper and lower walls for confining the ribbon therebetween, each of said upper and lower walls having openings therethrough enabling said entrance arm to flex without substantial rotation.

6. A cartridge according to claim 1 wherein said cartridge has a center of mass and is elongated in a longitudinal direction, at least three spacers projecting from said cartridge along one side thereof, two of said spacers projecting from said entrance and exit arms, respectively, on one side of said center of mass, the third spacer being located between said two spacers and spaced therefrom on the opposite side of the center of mass of said cartridge.

7. A cartridge according to claim 2 including means adjacent the tip of said exit arm defining an aperture for receiving a mounting post on a printer platform to maintain the exit arm substantially rigid relative to said printhead and said flexible entrance arm.

8. A cartridge according to claim 1 wherein said moving means includes a wheel within said cartridge having a female splined gear for coupling with a ribbon drive mechanism having a splined post carried by the printer.

9. A cartridge according to claim 1 wherein said entrance arm includes a guide adjacent its distal end about which the ribbon is routed for movement about an axis generally normal to said ribbon movement and for ribbon entry into said entrance arm, said guide having a central portion thereof of greater lateral extent relative to said axis than the lateral extent of said guide adjacent opposite ends thereof.

10. A cartridge according to claim 9 wherein said exit arm includes a guide adjacent its distal end about which the ribbon is routed for movement about an axis generally normal to ribbon movement, said guide having a central portion thereof of lesser lateral extent relative to said axis than the lateral extend of said guide adjacent opposite ends thereof.

11. A cartridge according to claim 1 wherein said exit arm includes a guide adjacent its distal end about which the ribbon is routed for movement about an axis generally normal to ribbon movement, said guide having a central portion thereof of lesser lateral extent relative to said axis than the lateral extent of said guide adjacent opposite ends thereof.

12. A cartridge according to claim 2 including means adjacent the tip of said exit arm defining an aperture for receiving a mounting post on a printer platform to maintain the exit arm substantially rigid relative to said printhead, said moving means including a wheel within said cartridge having a female splined gear for coupling with a ribbon drive mechanism having a splined post carried by the printer, said cartridge defining a plane containing said housing and said ribbon exit and entrance arms, said aperture defining means and said gear constituting the sole means carried by said cartridge for precluding movement of said cartridge in said plane when said cartridge is disposed in said printer.

13. A cartridge according to claim 12 wherein said cartridge has a center of mass and is elongated in a longitudinal direction, at least three spacers projecting from said cartridge along one side thereof, two of said spacers projecting from said entrance and exit arms, respectively, on one side of said center of mass, the third spacer being located between said two spacers and spaced therefrom on the opposite side of the center of mass of said cartridge, the spacer on said exit arm forming part of said aperture defining means.

14. A cartridge according to claim 1 wherein said moving means includes a pair of rollers defining, within said housing, a nip for receiving the ribbon, a pair of gears on one side of said rollers with said gears meshing one with the other adjacent said nip, and means for preventing displacement of the ribbon in the nip in a direction toward the meshed gears.

15. A ribbon cartridge for attachment to a printer, comprising:

a housing defining ribbon drive and ribbon storage chambers;

spaced-apart normally flexible inlet and outlet arms extending from the cartridge for delivering a substantial span of ribbon from said cartridge via said outlet arm to a print line established between said arms back to said cartridge via said inlet arm; and means for ensuring proper ribbon movement from said outlet arm to said inlet arm and relative to said established print line including means for rendering said outlet arm substantially rigid during ribbon movement in response to attachment to said printer, said inlet arm being configured to be substantially flexible during ribbon movement when attached to said printer for flexing movement toward and away from said rigid outlet arm.

16. A ribbon cartridge according to claim 15 wherein said inlet arm has a side wall and upper and lower walls for confining the ribbon therebetween, each of said upper and lower walls having openings therethrough enabling said inlet arm to flex substantially along the direction of ribbon movement and not in any other direction.

17. A ribbon cartridge according to claim 15 wherein said cartridge has a center of mass and is elongated in a longitudinal direction, at least three spacers projecting from said cartridge along one side thereof, two of said spacers projecting from said inlet and outlet arms, respectively, on one side of said center of mass, the third spacer being located between said two spacers and spaced therefrom on the opposite side of the center of mass of said cartridge.

18. A ribbon cartridge according to claim 15 including means adjacent the tip of said outlet arm defining an aperture for receiving a mounting post on a printer platform to maintain the outlet arm substantially rigid relative to said printer platform and said flexible inlet arm.

19. A ribbon cartridge according to claim 15 wherein said inlet arm includes a guide adjacent its distal end about which the ribbon is routed for movement about an axis generally normal to the desired direction of ribbon movement for ribbon entry into said inlet arm, said guide having a central portion thereof of greater lateral extent relative to said axis than the lateral extent of said guide adjacent opposite ends thereof.

20. A ribbon cartridge according to claim 15 wherein said outlet arm includes a guide adjacent its distal end about which the ribbon is routed for movement about an axis generally normal to the desired direction of ribbon movement, said guide having a central portion thereof of lesser lateral extent relative to said axis than the lateral extent of said guide adjacent opposite ends thereof.

21. A ribbon cartridge according to claim 15 including means adjacent the tip of said outlet arm defining an aperture for receiving a mounting post on a printer platform to maintain the outlet arm substantially rigid relative to said printer platform, said moving means including a wheel within said cartridge having a female splined gear for coupling with a ribbon drive mechanism having a splined post carried by the printer, said cartridge defining a plane containing said housing and said inlet and outlet arms, said aperture means and said gear constituting the sole means carried by said cartridge for precluding movement of said cartridge in said plane when said cartridge is disposed in said printer.

22. A ribbon cartridge according to claim 21 wherein said cartridge has a center of mass and is elongated in a longitudinal direction, at least three spacers projecting from said cartridge along one side thereof, two of said spacers projecting from said inlet and outlet arms, respectively, on one side of said center of mass, the third spacer being located between said two spacers and spaced therefrom on the opposite side of the center of mass of said cartridge, the spacer on said outlet arm forming part of said aperture defining means.

23. A ribbon cartridge for mounting on a printer platform for enabling printing along a print line on a record medium in response to actuation of a printhead moving along said print line, said cartridge comprising:

a housing defining a ribbon drive chamber;

a ribbon storage chamber coupled to said drive chamber and having a smaller width than said drive chamber, a ribbon drive means mounted in said drive chamber;

an inlet arm and an outlet arm extending from said cartridge for delivering a span of ribbon along said print line from said storage chamber and back into said drive chamber in response to an external force applied to said drive means; and means for maintaining proper ribbon movement in the span between said arms during printhead movement along said print line including means for maintaining said outlet arm rigid with respect to said print line and means for maintaining said inlet arm flexible for movement toward and away from said rigid outlet arm along the direction of said print line and without rotation of said inlet arm relative to the direction of ribbon movement during flexing of said inlet arm.

24. A ribbon cartridge according to claim 23 wherein said outlet arm includes a first spacer for spacing said cartridge above said platform, said spacer having means for rigidly attaching said cartridge to said platform, said inlet arm also including a second spacer, and a third spacer located on said drive chamber housing adjacent said coupling of said chambers and remote from said first and second spacers.

25. A high speed shuttle matrix printer cartridge carrying a print ribbon for disposition in a print position between a printhead and a print recording medium, comprising:

a housing defining a storage chamber for the ribbon;

means including ribbon exit and entrance arms spaced one from the other and projecting from said housing in a spaced-apart cooperating relationship for routing the ribbon from the storage chamber along said exit arm into the print position and from the print position along said entrance arm to the storage chamber;

means for moving the ribbon into said storage chamber thereby displacing the ribbon from the exit arm through the print position and along the entrance line, said moving means including, within said housing, a pair of rollers defining a nip for receiving the ribbon, and a pair of gears on one side of said rollers with said gears meshing one with the other adjacent said nip; and means, with said housing, for preventing displacement of the ribbon in the nip in a direction toward the meshed gears.

26. A cartridge according to claim 25 wherein said cartridge has a center of mass and is elongated in a longitudinal direction, at least three spacers projecting from said cartridge along one side thereof, two of said spacers projecting from said entrance and exit arms, respectively, on one side of said center of mass, the third spacer being located between said two spacers and spaced therefrom on the opposite side of the center of mass of said cartridge.

27. A cartridge according to claim 25 wherein said entrance arm includes a guide adjacent its distal end about which the ribbon is routed for movement through the space between said arms and for ribbon entry into the entrance arm, said guide having a central portion thereof of greater lateral extent relative to said axis than the lateral extent of said guide adjacent opposite ends thereof.

28. A cartridge according to claim 25 wherein said exit arm includes a guide adjacent its distal end about which the ribbon is routed for movement through the space between said arms and for ribbon entry into the entrance arm, said guide having a central portion thereof of lesser lateral extent relative to said axis than the lateral extent of said guide adjacent opposite ends thereof.

* * * * *